US010978845B1

(12) United States Patent
West

(10) Patent No.: US 10,978,845 B1
(45) Date of Patent: Apr. 13, 2021

(54) PUNCH DOWN TOOL

(71) Applicant: Jeff West, Wilmington, NC (US)

(72) Inventor: Jeff West, Wilmington, NC (US)

( * ) Notice: Subject to any disclaimer, the term of this patent is extended or adjusted under 35 U.S.C. 154(b) by 197 days.

(21) Appl. No.: 16/183,854

(22) Filed: Nov. 8, 2018

(51) Int. Cl.
*H01R 43/01* (2006.01)
*H01R 43/042* (2006.01)

(52) U.S. Cl.
CPC ..... *H01R 43/015* (2013.01); *H01R 43/042* (2013.01)

(58) Field of Classification Search
CPC ..... H01R 43/015
USPC ..... 29/760
See application file for complete search history.

(56) References Cited

U.S. PATENT DOCUMENTS

| | | | | |
|---|---|---|---|---|
| 6,351,865 | B1 | 3/2002 | De Donato | |
| 6,615,480 | B1 | 9/2003 | Murphy | |
| 2003/0115737 | A1* | 6/2003 | Minor | H01R 43/015 29/566.4 |
| 2004/0121798 | A1* | 6/2004 | Hamasaki | G06F 1/163 455/550.1 |

OTHER PUBLICATIONS

CableSupply, "Jack Puck Helper Tool and Ethernet Jack Termination Tutorial", Dec. 27, 2011, https://www.youtube.com/watch?v=y-hlpbWvrYI (Year: 2011).*

* cited by examiner

*Primary Examiner* — Livius R. Cazan

(74) *Attorney, Agent, or Firm* — Sanchelima & Associates, P.A.; Christian Sanchelima; Alexander Rodriguez

(57) ABSTRACT

The present invention relates to a punch down tool comprising a handle, a holder extending from the handle, and a down blade assembly operably connected to the holder. The down blade assembly comprises at least two down blades, wherein the down blades include a U-shaped cut out configured thereon for accommodating a wire that is to be crimped into a connector. The tool further comprises a housing in which the down blades are disposed such that the down blades are linearly displaceable within the housing. A cutting blade is also provided on the housing.

10 Claims, 4 Drawing Sheets

PUNCH DOWN TOOL

BACKGROUND OF THE INVENTION

1. Field of the Invention

The present disclosure relates to a termination/punch down tool which connect wires to category 5 connectors, category 6 connectors and the like.

2. Description of the Related Art

Connecting the category 5 or category 6 cables to the corresponding connectors requires the use of a specialized tool, typically know as a punch down tool. A disadvantage of the conventional punch down tool is that the crimping operation for crimping the cable into the corresponding connector, using the conventional punch down tool, is time consuming and inconvenient. This is because the operator has to crimp each wire of the cat 5 or cat 6 cable into the corresponding terminals of the connector.

Several designs for such punch down tools have been designed in the past. None of them, however, are known to be reduce the time and effort associated with performing the crimping of a cat 5 or cat 6 cable into the corresponding connector.

Applicant believes that a related reference corresponds to U.S. Pat. No. 6,615,480 filed by STACEY A. MURPHY. The Murphy reference discloses a blade assembly for a punch down tool, which includes a base member having a mounting block. The mounting block is releasably attachable to the chuck of a punch down tool. However, the Murphy reference fails to disclose any feature of the punch down tool that reduces the time and effort associated with performing the crimping of a cat 5 or cat 6 cable into the corresponding connector.

Another related application is U.S. Pat. No. 6,351,865 filed by JACK DE DONATO. The Donato reference discloses a hand tool incorporating a wire stripper, a wire cutter, and a punch-down tool all in a single unit. However, the Murphy reference fails to disclose any feature of the punch down tool that reduces the time and effort associated with performing the crimping of a cat 5 or cat 6 cable into the corresponding connector.

Other documents describing the closest subject matter provide for a number of more or less complicated features that fail to solve the problem in an efficient and economical way. None of these patents suggest the novel features of the present invention.

SUMMARY OF THE INVENTION

It is an object of the present invention to provide punch a down tool for crimping wires of a cat5 or a cat6 cables into a corresponding connector.

It is yet another object of the present invention to provide a punch down tool for crimping wires of a cat5 or a cat6 cables into a corresponding connector, which reduces the required time and effort relative to the use of the conventional punch down tools.

Further objects of the invention will be brought out in the following part of the specification, wherein detailed description is for the purpose of fully disclosing the invention without placing any limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
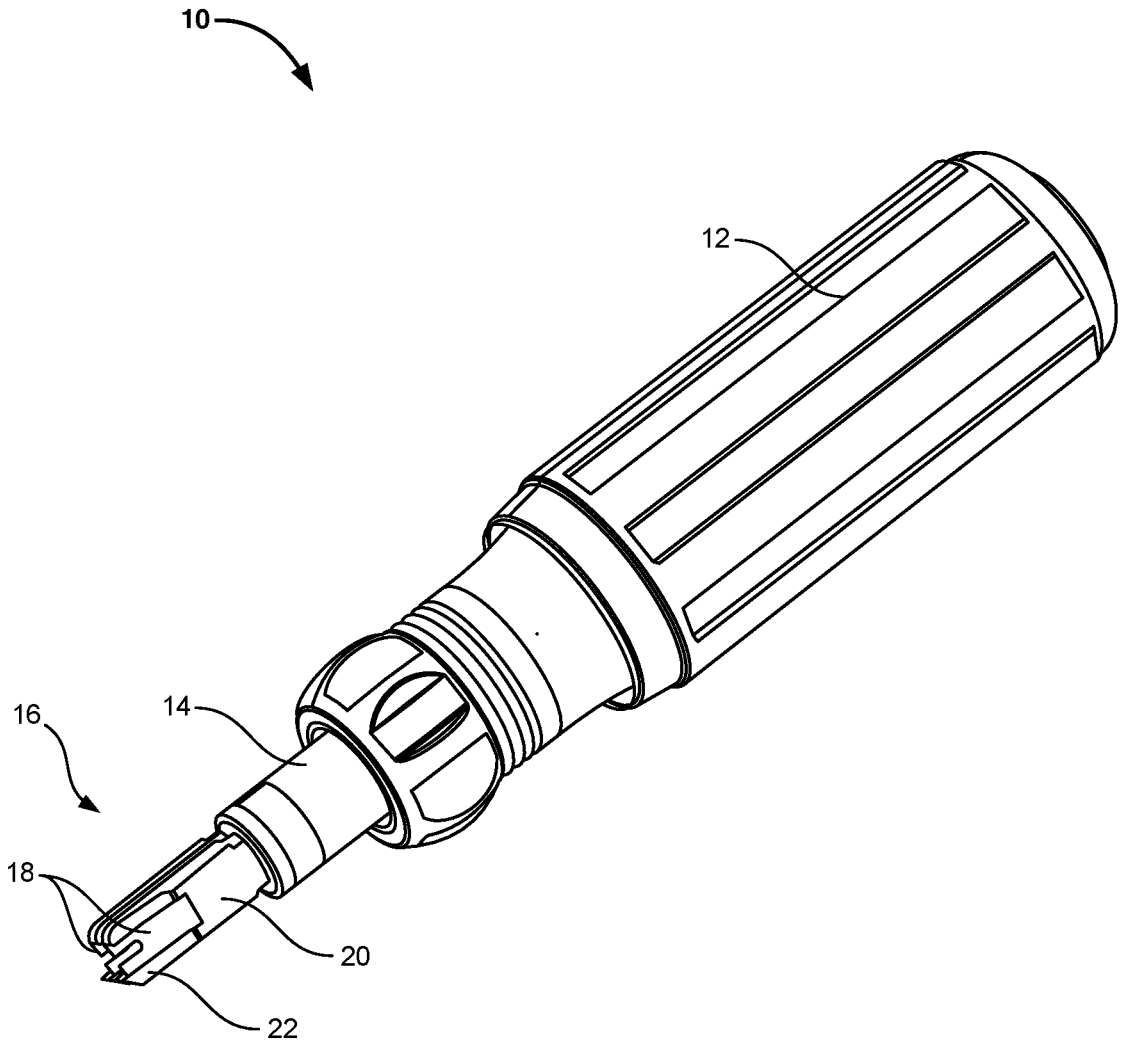
FIG. 1 illustrates an isometric view of a punch down tool 10, in accordance with an embodiment of the present invention, wherein the punch down tool 10 comprises a handle 12, a holder 14 extending from the handle 12, and a down blade assembly operably connected to the holder 14.
Figure 2:
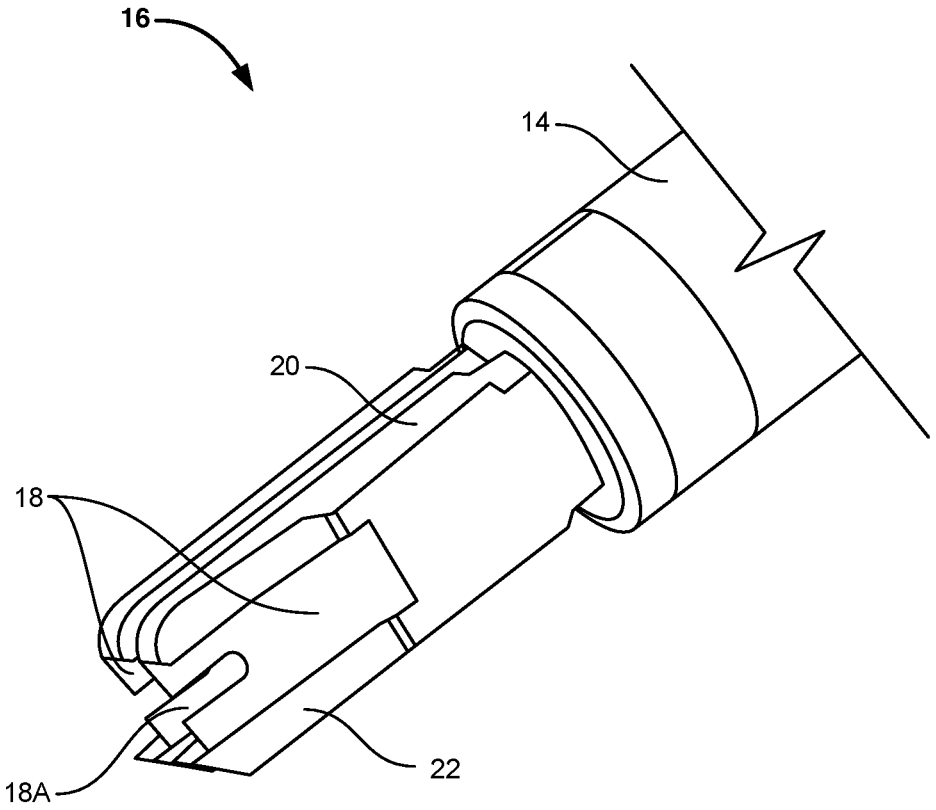
FIG. 2 illustrates an enlarged isometric view of the down blade assembly 16, which includes at least two down blades 18 having a cut out 18A configured thereon, wherein the down blades 18 is disposed within the housing 20, within which the down blades are linearly displaceable.

Referring now to FIGS. 1-4, where the present invention is generally referred to with numeral 10, it can be observed that a punch down tool 10 (hereinafter also referred to as tool 10) comprises a handle 12, a holder 14, and a down blade assembly 16 held by the holder 14. In accordance with an embodiment of the present invention, the down blade assembly 16 comprises at least two down blades 18, which allow a user to crimp at least two wires of a cat5 or a cat6 cable to a corresponding connector (not shown in figures), thereby reducing the time required for crimping at least by half relative to the time required to do the same job with a conventional punch down tool, which can crimp only one wire at a time.

The tool 10 further comprises a housing 20, in which the down blades 18 are disposed. The down blades 18 is disposed within the housing in a manner that the down blades 18 can be linearly displaceable within the housing 20. The purpose of providing the linear displacement to the down blades 18 is that during crimping, the down blades 18 are required to be displaced as the tool 10 is pressed onto the connector. The down blades 18 include a cut out 18A. In an embodiment, the cut out 18A has a U-shaped configuration. The U-shaped configuration of the cut out 18A allows the wire to be crimped to be accommodated within the cut out 18A.

The down blade assembly 16 further comprises at least one cutting blade 22. The cutting blade 22 is provided for cutting of sections of the wires of the cat5 or the cat6 cable that tend to extend beyond the edges of the connector after the crimping of the wire onto the corresponding port on the connector is performed. The cutting blade 22 is provided on the housing 16 such that when the crimping operation is performed by the tool 10, the cutting blade 22 passes adjacent the edge of the connector wherefrom the sections of wire extend subsequent to the crimping, thereby cutting off the extended wire sections.

The tool 10 further comprises a punch down pad 24. The punch down pad 24 is provided so that the connector can be held within the punch down pad 24 while the punching down operation is being performed on the connector. More specifically, while the punching down operation or crimping operation is performed for connecting a cat5 or a cat6 cable to the corresponding connector, a downward force needs to be applied on the connector by the tool 10. This typically causes the area around the connector, such as a surface of a table on which the connector is placed while the punch down operation is performed, to be affected. This is not desired.

To overcome the aforementioned issue, the punch down pad 24 is provided with a plurality of apertures 26 in which the connector can be placed while the punch down operation is being performed. Furthermore, the finger loops 28 are provided on the punch down pad 24 for allowing the user to hold the punch down pad 24 and the connector in the palm of his hand, while he performs the crimping or punch down operation on the connector using the tool 10. This overcomes drawback of spoiling the support surface on which the connector is placed while the crimping or punch down operation is performed.

Figure 3:
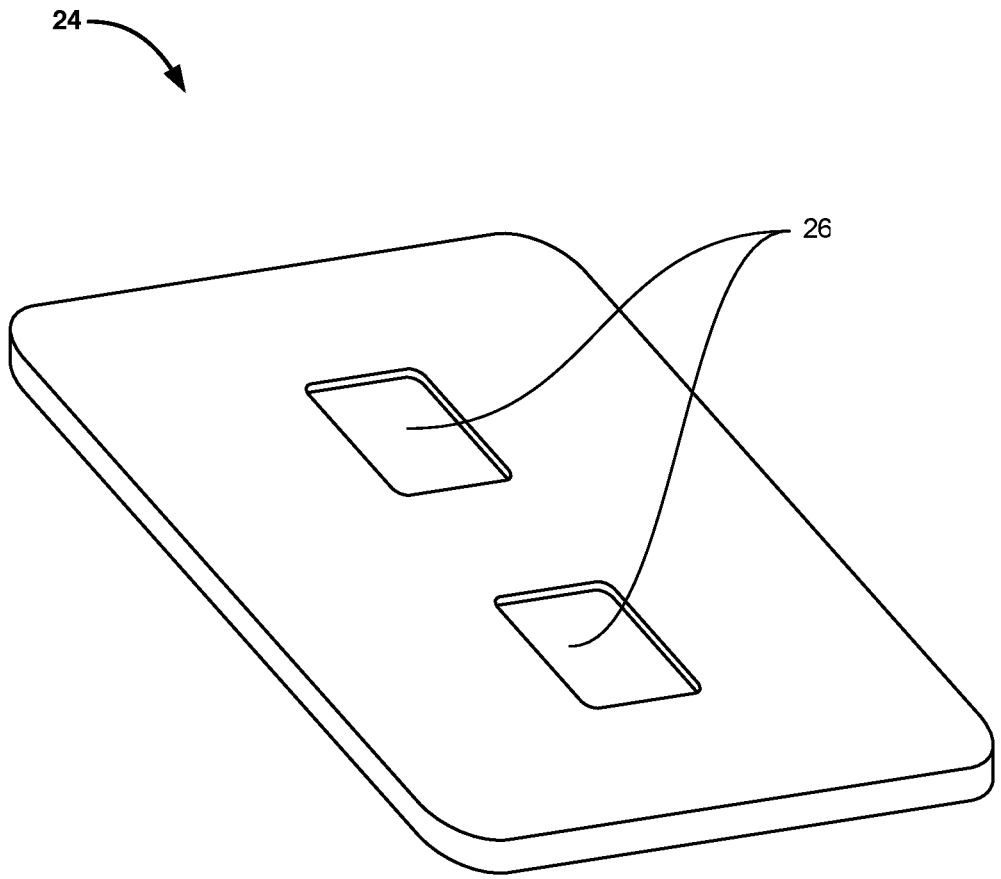
FIG. 3 illustrates an isometric view of a punch down pad 24, in accordance with an embodiment of the present invention, wherein the punch down pad 24 includes apertures 26 configured thereon.
Figure 4:
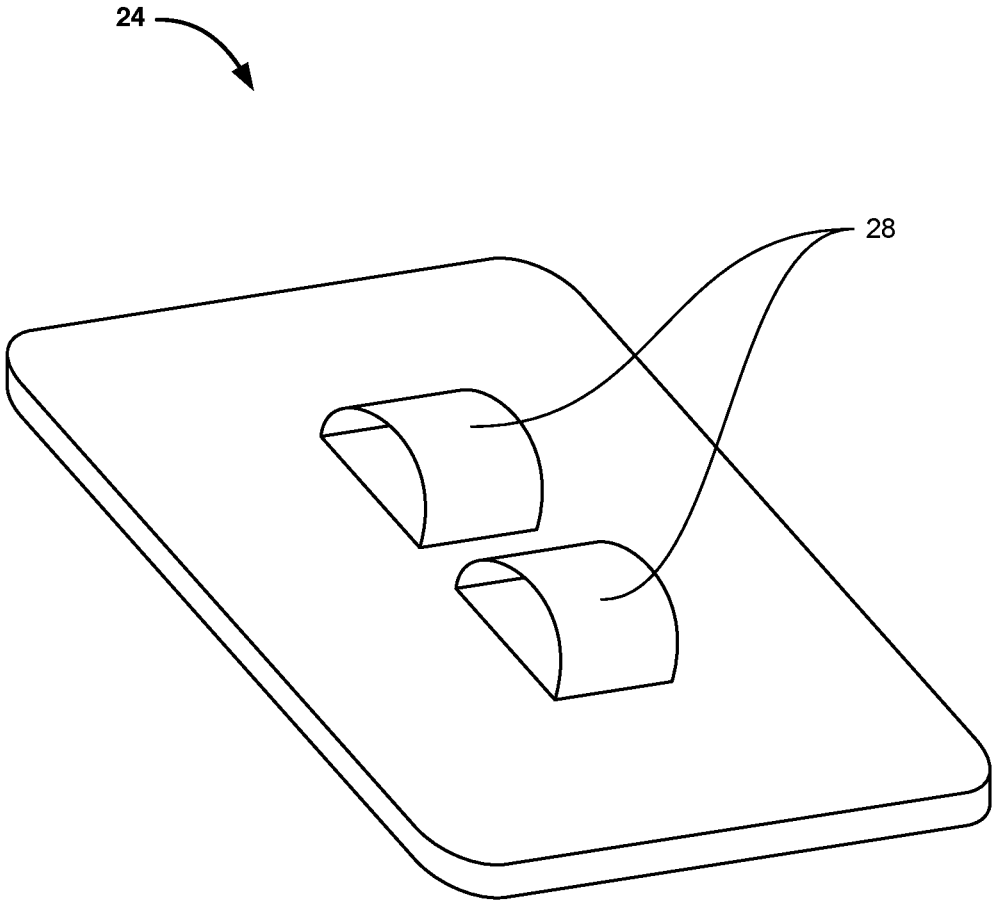
FIG. 4 illustrates another isometric view of the punch down pad 24, wherein finger loops 28 are provided at an operative bottom surface of the punch down pad 24.

The punch down pad 24, as illustrated in FIGS. 3 and 4, are configured to hold individual cat5/cat6 connectors therewithin. However, other embodiments of the punch down pad 24 can also be configured to hold punch down blocks or panels on which an array of connectors are configured.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A punch down tool comprising:

a) a handle with a cylindrical shape having a first and second end, wherein said handle includes a connecting member extending from said first end, said connecting member comprising of a tapered portion and a receiving member coupled to a distal end of said tapered portion;

b) a holder extending outwardly from said receiving member of said connecting member of the handle, said holder being partially recessed within said receiving member; and c) a down blade assembly operably connected to the holder, wherein said down blade assembly includes a housing having a rectangular shape, wherein said housing includes at least two down blades contained therein, wherein said at least two down blades begin along a distal edge of said housing and extend partially into said housing, said at least two down blades each including four perimeter sides, wherein three of said four perimeter sides are enclosed by said housing, said at least two down blades further each including an outer surface being in a constant exposed state from said housing, wherein each of said at least two down blades include a U-shaped cut out adapted to accommodate wiring, said housing further including at least one cutting blade, wherein said at least one cutting blade is positioned adjacently to one of said four perimeter sides of said at least two down blades.

2. The punch down tool as claimed in claim 1, wherein the at least two down blades are linearly movable within the housing.

3. The punch down tool as claimed in claim 1, further comprises a punch down pad for holding a connector therewithin.

4. The punch down tool as claimed in claim 3, wherein punch down pad comprises a plurality of apertures, wherein the connector is placed inside the apertures while the wires are being crimped into the connector.

5. The punch down tool as claimed in claim 4, wherein the punch down pad comprises at least one finger loop for facilitating holding the punch down pad within the palm of the user.

6. The punch down tool of claim 1 wherein said handle includes an outer surface having an alternating pattern consisting of recessed channels and raised channels.

7. The punch down tool of claim 1 wherein said receiving member is circular in shape with an outer surface having an alternating pattern consisting of recessed channels and raised channels.

8. The punch down tool of claim 1 wherein said tapered portion is recessed within said first end of said handle.

9. The punch down tool of claim 1 wherein said at least one cutting blade extends beyond a distal edge of one of said at least two down blades.

10. A punch down tool kit, consisting of:

a) a handle with a cylindrical shape having a first and second end, wherein said handle includes a connecting member extending from said first end, said connecting member comprising of a tapered portion and a receiving member coupled to a distal end of said tapered portion;

b) a holder extending outwardly from said receiving member of said connecting member of the handle, said holder being partially recessed within said receiving member;

c) a housing extending from the holder, wherein said housing has a rectangular shape;

d) two down blades contained within said housing, wherein said two down blades begin along a distal edge of said housing and extend partially into said housing, said two down blades each including four perimeter sides, wherein three of said four perimeter sides are enclosed by said housing, said two down blades further each including an outer surface being in a constant exposed state from said housing, wherein each of said two down blades include a U-shaped cut out adapted to accommodate wiring e) a cutting blade provided on the housing, wherein said cutting blade is positioned adjacently to one of said four perimeter sides of said two down blades;

f) a punch down pad for holding a connector therewithin, wherein said punch down pad includes a first surface side and a second surface side, wherein said punch down pad includes two apertures on said first surface side, wherein the connector is placed inside the two apertures while the wiring is being crimped into the connector, wherein the punch down pad comprises two finger loops protruding from said second surface side of said down pad, said two finger loops forming arches which facilitate the receiving of a user's fingers.

* * * * *